United States Patent [19]

Tolstopyatov et al.

[11] 4,453,348

[45] Jun. 12, 1984

[54] APPARATUS FOR ABRASIVE MACHINING OF WORKPIECES

[76] Inventors: Konstantin S. Tolstopyatov, ulitsa Pervomaiskaya, 30, kv. 24, Elektrostal Moskovskoi oblasti; Anatoly A. Lukyanov, ulitsa Rogozhskaya, 100b, Noginsk Moskovskoi oblasti; Viktor I. Burmakin, ulitsa Stalevarov, 5, kv. 2, Elektrostal Moskovskoi oblasti; Igor S. Pryanishnikov, ulitsa Nikolaeva, 23, kv. 44, Elektrostal Moskovskoi oblasti; Gennady N. Maslov, ulitsa Pervomaiskaya, 34-19, kv. 25, Elektrostal Moskovskoi oblasti; Mikhail U. Zemtsov, ulitsa Delegatskaya, 9, kv. 110, Moscow; Nikolai G. Bobovnikov, ulitsa Sovetskaya, 1, kv. 43, Elektrostal Moskovskoi oblasti; Viktor A. Sorokin, prospekt Lenina, 38/7, kv. 5, Elektrostal Moskovskoi oblasti; Nikolai B. Marchenkov, ulitsa Yalagina, 22, kv. 37, Elektrostal Moskovskoi oblasti; Alexandr L. Pyatibrat, ulitsa Mayakovskogo, 13, kv. 16, Elektrostal Moskovskoi oblasti; Ernst L. Tonaevsky, ulitsa Sovetskaya, 64, kv. 9, Noginsk Moskovskoi oblasti, all of U.S.S.R.

[21] Appl. No.: 417,028

[22] Filed: Sep. 13, 1982

Related U.S. Application Data

[63] Continuation of Ser. No. 184,420, Sep. 5, 1980, abandoned.

[51] Int. Cl.[3] ..... B24B 7/00

[52] U.S. Cl. ..... 51/109 R; 51/166 MH

[58] Field of Search ..... 51/109, 110, 165 R, 51/165.77, 55, 166 MH, 118, 126

[56] References Cited

U.S. PATENT DOCUMENTS

| | | | |
|---|---|---|---|
| 1,783,960 | 12/1930 | Fox | 51/55 |
| 2,375,333 | 5/1945 | Troendly | 51/118 |
| 2,442,042 | 5/1948 | Hamilton | 51/166 MH |
| 2,487,709 | 11/1949 | Hodges | 51/166 MH |
| 2,558,943 | 7/1951 | Ellison | 51/166 MH |
| 3,021,647 | 2/1962 | Maitenaz | 51/55 |

*Primary Examiner*—Harold D. Whitehead

*Attorney, Agent, or Firm*—Robert E. Burns; Emmanuel J. Lobato; Bruce L. Adams

[57] ABSTRACT

An apparatus for abrasive machining of workpieces comprises a base in the form of a carriage, a tool head having a spindle with an abrasive tool fastened thereto, an articulated four-bar linkage, a drive for rotating the abrasive tool and an actuating cylinder for urging the abrasive tool to a workpiece, the actuating cylinder being pivotally mounted on the base and a movable link thereof being pivotally connected to one link of the articulated four-bar linkage. The spindle of the tool head is arranged in a plane of the articulated four-bar linkage and connected to the drive for rotating the abrasive tool through a telescoping cardan shaft to thereby considerably reduce the bulk of the tool head movable parts and improve the tracing of the tool over the surface of the workpiece being machined.

4 Claims, 1 Drawing Figure

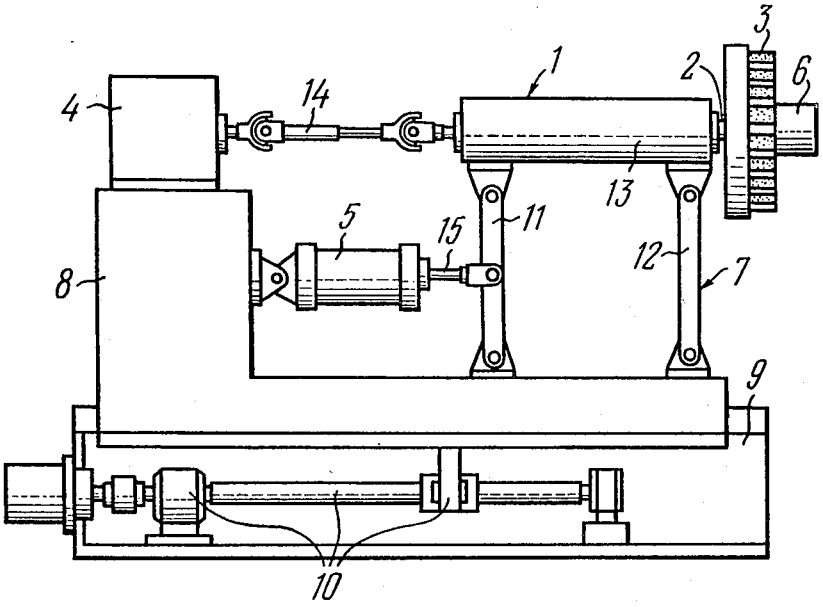
1
2
3
4
5
6
7
8
9
10
11
12
13
14
15

APPARATUS FOR ABRASIVE MACHINING OF WORKPIECES

This is a continuation, of application Ser. No. 184,420, filed 9-5-80 and now abandoned.

BACKGROUND OF THE INVENTION

The present invention relates to machines for surfacing of workpieces, such as ingots, electrodes, billets or bars, for use in the metallurgical industry and more particularly to an apparatus for abrasive machining of workpieces.

Apparatus for abrasive machining or workpieces of various designs are known in the art as exemplified by U.S. Pat. No. 2,142,736 /Cl. 90–18/, wherein there is provided an apparatus comprising a tool made fast on a spindle, the axis of which is perpendicular to the surface of a slab to be machined, a tool head with the spindle mounted on a bed and, also mounted on the bed, two drive means, viz. a traverse feed motor and a tool driving motor, the latter of which is connected to the spindle through a V-type belt.

In the course of machining the tool is initially positioned for removing a layer of selected thickness and thereafter the tool driving motor is engaged for surfacing the slab while the latter is being fed perpendicularly in relation to the axis of the spindle. However, this apparatus fails to provide the tracing of the tool over the curves of the surface being machined and therefore fails to ensure a uniform scalping or removal of metal along the entire length of the slab because the tool head is rigidly secured to the bed and is incapable of axial movement during slab machining.

Another prior art apparatus intended for abrasive machining of billets/cf. British Pat. No. 995,125, Cl. B3 D, published 1965provides a tool carrier supporting a grinding wheel made fast on a spindle. The carrier is pivotally connected to a bed through a rocker-arm, a tool drive means is arranged on the carrier, a traverse feed drive means, and an actuating hydraulic cylinder for urging the tool to the billet surface being machined. The cylinder is pivotally connected to the bed and the tool carrier. In the course of machining the actuating hydraulic cylinder acts to urge the tool to the billet, whereas the tool oscillation transversely of the continuous advancement of the workpiece is effected by a rocker-arm drive. However, this apparatus also fails to ensure metal scalping of a uniform thickness due to the fact that the traverse feed drive mechanism is incapable of providing a steady cutting engagement of the tool with a workpiece being machined.

The use of more powerful drive means for grinding tools leads to an increase in the bulk of tool heads, thus lowering the frequency of the reciprocating motion thereof across the workpiece being machined owing to greater dynamic loads which results in deteriorated quality and reduced efficiency of machining.

In still another known apparatus for abrasive machining /cf. GDR Pat. No. 26,927, Cl. 67a/3, published 1964/ which is the closest analogue of the present invention, the rod of an actuating cylinder is pivotally connected to one link of an articulated four-bar linkage, the link is shaped as a two arms lever carrying a counterweight acting to balance an abrasive tool. The rod cooperates with the two arms lever through a shackle having a slidable provision for a slide block. The above apparatus is not free of disadvantages in that tracing of the tool over the surface being machined is done in only one direction from the original setting of the tool, thereby leaving unsurfaced cavities on the workpiece being machined. Also, a bulky tool drive means in conjunction with the counter-weight adds to the forces of inertia, which complicate the tracing of the tool over the workpiece surface.

The heretofore described apparatus along with numerous other machines are incapable of affecting mass production abrasive machining of high efficiency, since recent advances in the art of abrasive machining have evidenced a steady increase in the rate of cutting speeds and specific forces acting to urge a tool to a workpiece, which are difficult to realize in conventional abrasive machines. In this connection, problems arise in the designing of circular grinding machines having wheel rotation speeds of up to 100-14 120 m/s, reliable spindle bearings and drive-to-spindle power transmissions.

SUMMARY OF THE INVENTION

One object of the present invention is to improve the efficiency of workpiece machining through reducing the bulk of a movable assembly cooperating with a tool in tracing over the surface to be machined.

Another object of the present invention is to ensure such urging of the abrasive tool to the workpiece being machined as to afford a slice of metal of uniform thickness to be removed from both concave and convex portions thereof.

Still another object of the present invention is to provide an apparatus for workpiece machining wherein a side face operable abrasive tool can be utilized.

These and further objects of the present invention are attained in an apparatus for abrasive machining of workpieces comprising an abrasive tool fastened to a spindle of a tool head mounted on an articulated four-bar linkage which is secured on a base, a drive means for rotating the abrasive tool, and an actuating cylinder for urging the abrasive tool to a workpiece with a movable link thereof pivotally connected to one link of the articulated four-bar linkage according to the invention, the spindle of the tool head is arranged in a plane of the articulated four-bar linkage and cooperates with the drive means rotating the abrasive tool through a telescoping cardan shaft, which drive means is secured on the base, viz. a carriage, whereupon the actuating cylinder for urging the abrasive tool is pivotally mounted.

The constructional arrangement of the spindle in the plane of the four-bar linkage affords the application of a side face operable abrasive tool, enabling to thereby maintain a constant cutting speed not affected by wear of the tool during machining.

The use of the telescoping cardan shaft as a connection between the spindle and the drive means allows to considerably reduce the bulk of the tool head movable parts, improve the tracing of the tool over the surface machined, and finally to decrease the waste of metal.

Employment of the pivotable actuating cylinder in conjunction with the carriage enables the apparatus to machine curved workpieces having both concave and convex surfaces.

BRIEF DESCRIPTION OF THE DRAWING

The invention will now be described in greater detail with reference to a specific embodiment thereof, taken in conjunction with the accompanying drawing, illustrating a preferred embodiment of the apparatus for abrasive machining according to the invention.

DESCRIPTION OF THE PREFERRED EMBODIMENT

The proposed apparatus for abrasive machining of workpieces comprises a tool head 1 of any known construction having a side face operable abrasive tool 3 fastened to a spindle 2; a drive means 4 for rotating the side face operable abrasive tool 3; an actuating cylinder 5 for urging the side face operable abrasive tool toward a workpiece 6; or away therefrom. An articulated four-bar linkage 7 supports the tool head and a base is provided in the form of a carriage 8 movable along guideways of a stationary bed 9 by means of any known drive 10, such as a screw drive.

Configured as shown in the figure of the accompanying drawing, the carriage 8 includes the drive means 4 for rotating the abrasive tool, the actuating cylinder 5 and the articulated four-bar linkage 7.

The body of the actuating cylinder 5 and links 11 and 12 of the articulated four-bar linkage 7 are pivotally mounted on the carriage 8, the articulation between all the links of the four-bar linkage 7 and the base and the body of the actuating cylinder 5 being of any known construction.

Pivotally mounted on the links 11 and 12 of the articulated four-bar linkage 7 is a body of the tool head 1, the spindle 2 thereof being arranged in a plane of the articulated four-bar linkage 7, whereby the spindle 2 is one link of the articulated four-bar linkage 7.

The spindle 2 is connected to the drive shaft of the drive 4 through a telescoping cardan shaft 14 having any known construction and comprising two slidingly cooperating portions thereof.

The movable link of the actuating cylinder 5, viz. a rod 15, is pivotally connected to the link 11 of the articulated four-bar linkage 7, whereby the abrasive tool can be resiliently urged to the surface of the workpiece 6 and caused to trace the contour thereof. This is further facilitated by the telescoping construction of the cardan shaft 14 and the pivotable connection of the body of the actuating cylinder with the carriage 8.

Longitudinal feeding movement of the workpiece 6 in a plane substantially perpendicular to the axis of the spindle 2 is effected by any known means/not shown/.

The proposed apparatus works as follows.

Upon approach of the front end of the workpiece 6 to the rotating side face operable tool 3 the latter is urged to the surface of the workpiece 6 with a selected force by the actuating cylinder 5, whereafter scalping the surface of the workpiece 6 being fed perpendicularly to the spindle 2 of the apparatus is effected by the side face of the tool 3. In the instances where the surface of the workpiece has curved contours, the tool head 1 mounted on the links of the articulated four-bar linkage 7 oscillates axially by virtue of the actuating cylinder 5, thereby providing a uniform thickness of metal to be removed at a selected force of urging of the tool to the workpiece.

After the scalping is completed, the retraction of the tool 3 from the workpiece 6 is effected by the same cylinder 5.

The carriage 8 can be returned to its initial position by means of the drive 10 along the guideways of the bed 9 for tool replacement.

What is claimed is:

1. Apparatus for abrading machining a workpiece comprising, an articulated four-link linkage comprising a movable carriage having two pivoted parallel links each having an end pivotally mounted on said carriage, an elongated tool head constituting a link of said four-link linkage, a driven spindle extending axially through said tool head for mounting an abrading tool thereon, means pivotally connecting the two parallel links in a common plane thereof pivotally connected to said tool head, said spindle being disposed in said plane rotational in said tool head, drive means for rotatably driving said spindle selectively in said elongated tool head comprising a driven telescoping cardan shaft in said plane connected to the spindle and extending axially thereof, actuating means pivotally mounted on said carriage and pivotally connected to one of said two parallel links for selectively actuating jointly the two parallel links of said four-link linkage to advance the tool head longitudinally toward and away from the workpiece and resiliently engage the abrading tool with the workpiece, said telescoping cardan shaft being mounted for telescopically extending as said tool head is advanced toward the workpiece and telescopically retracting as said tool head is moved away from said workpiece when said two parallel links are actuated, and means independent of said actuating means to selectively move the carriage to move said actuating means and two parallel links and the elongated tool head of the linkage jointly toward or away from the workpiece.

2. Apparatus for abrasing machining a workpiece according to claim 1, in which said plane in which said spindle is disposed corresponds to a plane in which said workpiece is disposed.

3. Apparatus for abrading machining a workpiece according to claim 1, in which said actuating means comprises an actuating cylinder having a piston in said plane pivotally connected to said one of said two parallel links.

4. Apparatus for abrading machining a workpiece according to claim 1, in which said drive means comprises a motor mounted on said carriage for driving said telescoping cardan shaft, and said cardan shaft and said spindle being disposed horizontally.

* * * * *